US006824674B2

(12) United States Patent
Kaminsky

(10) Patent No.: US 6,824,674 B2
(45) Date of Patent: Nov. 30, 2004

(54) PYROLYSIS GASOLINE STABILIZATION

(75) Inventor: Mark P. Kaminsky, Friendswood, TX (US)

(73) Assignee: Equistar Chemicals, LP, Houston, TX (US)

( * ) Notice: Subject to any disclaimer, the term of this patent is extended or adjusted under 35 U.S.C. 154(b) by 74 days.

(21) Appl. No.: 10/158,284

(22) Filed: May 30, 2002

(65) Prior Publication Data

US 2003/0221993 A1 Dec. 4, 2003

(51) Int. Cl.[7] ..... C10G 45/32; C07C 5/02

(52) U.S. Cl. ..... 208/143; 208/144; 585/260; 585/275; 585/276

(58) Field of Search ..... 208/143, 144; 585/260, 275, 276

(56) References Cited

U.S. PATENT DOCUMENTS 5,348,928 A * 9/1994 Kukes et al. ..... 502/306

OTHER PUBLICATIONS

Alvin B. Stiles, *Catalyst Manufacture Chemical Industries*, published by Marcel Dekker, 1983, vol. 14, pp. 3–13, 86–91, 103–107, 129–131.

S. J. Gregg and K. S. W. Sing, *Adsorption, Surface Area and Porosity, Second Edition*, published by Academic Press, 1982, pp. 283–287.

* cited by examiner

*Primary Examiner*—Walter D. Griffin
(74) *Attorney, Agent, or Firm*—Roderick W. MacDonald

(57) ABSTRACT

A method for increasing the operational life-time of a pyrolysis gasoline hydrotreating process using a supported Group VIII metal catalyst by employing a catalyst having a significantly increased total surface area.

18 Claims, No Drawings

PYROLYSIS GASOLINE STABILIZATION

BACKGROUND OF THE INVENTION

1. Field of the Invention

This invention relates to the stabilization of pyrolysis gasoline ("pygas"), and more particularly to lengthening the life-time cycle of first stage hydrogenation of pygas.

2. Description of the Prior Art

Crude oil fractions such as a straight run naphtha from a crude oil still are conventionally steam cracked in a olefins unit to produce light olefins and aromatics, valuable chemicals in their own right. Pygas is a valuable by-product of such steam cracking because it is generally high octane and within the general gasoline boiling range of from about 100 to about 420° F., and can be used as a finished gasoline blending stream after undergoing certain processing before blending.

Because pygas is derived from steam cracking complex hydrocarbon streams such as naphthas, it can carry with it a large amount of widely varying catalyst poisons that interfere with the aforesaid pre-blending processing of pygas. The amount and severity of pygas poisons is unusually severe as compared to other gasoline producing streams, e.g., gasolines from catalytic cracking units. This makes pygas pre-blending processing quite detrimental to catalyst life during such processing.

Also unlike other gasoline streams used for finished gasoline blending, pygas, before first stage hydrotreating, contains substantial amounts of gum precursors, and has poor oxidation stability.

Accordingly, pygas is challenging to stabilize and otherwise process before gasoline blending is undertaken.

The first stage of pygas processing before blending is often hydrotreating over a Group VIII metal catalyst (iron, cobalt, nickel, ruthenium, rhodium, palladium, osmium, iridium, and platinum) to selectively hydrogenate gum precursors such as diolefins, acetylenics, styrenics, dicyclopentadiene, and the like while not hydrogenating significant amounts of mono-olefins, aromatics, and other gasoline octane enhancers. Competitive adsorption causes diolefins and acetylenics to be hydrogenated preferentially over mono-olefins and aromatics thus removing gum tendencies while maintaining octane value. Paraffins are left unchanged or mildly isomerized which can help gasoline value.

Sometimes several stages of selective hydrogenation are carried out.

Second stage hydrotreating is often done on a BTX (benzene, toluene, and xylenes) fraction of pygas for removal of sulfur and other impurities.

The poison severity usually found in pygas can severely reduce first stage hydrogenation catalyst activity and catalyst life. For example, while sulfur, carbonyls, basic nitrogen, and gums/coking tend to be temporary catalyst poisons, arsenic, mercury, lead, and phosphorous tend to be more permanent poisons. Other permanent poisons include trace silicon oxide and corrosion metal oxide dusts which tend to plug catalyst pores. Also, polysiloxanes thermally decomposed and permanently poison palladium or nickel catalysts.

Guard beds can be employed upstream of a first stage hydrotreater to remove such poisons, but this is an expensive approach, and it is not always physically possible or otherwise practical to install guard beds and regeneration capability.

Thus, it is very desirable to have a pygas first stage hydrogenation catalyst that remains robust as to both selective hydrogenation activity and catalyst life when exposed to the pygas poison severity without resorting to a guard bed or other processing to remove or neutralize poisons before such first stage hydrotreating.

DETAILED DESCRIPTION OF THE INVENTION

It has been surprisingly found that in the context of hydrotreating pygas using a supported Group VIII metal catalyst, the operating life-time of this hydrotreating process can be significantly increased (lengthened) by deliberately employing a supported catalyst having a substantially increased total surface area, and that the process life-time extending improvement of this invention, in this context, is, contrary to certain conventional wisdom, independent of the average pore diameter of the catalyst and amount of Group VIII metal carried by the catalyst.

By "operating life-time" of the hydrotreating process, what is meant is the active life-time of a single batch of supported Group VIII metal catalyst continually operating from start up when the catalyst is fresh and has not yet seen any pygas until the commercial hydrotreating efficiency of said catalyst batch has been essentially exhausted.

By "total surface area" what is meant is the combined surface area of the Group VIII metal and the surface area of the porous support material which carries said metal. The average pore diameter referred to is the average diameter of the pores found throughout the catalyst, particularly the support material.

In accordance with this invention, the life-time of a conventional first stage pygas hydrotreating process that uses a supported Group VIII metal catalyst is extended by deliberately selecting from a plurality of available catalysts an individual catalyst that has one of the larger total surface areas of the catalysts in that suite of catalysts, and employing said individual catalyst in said process.

It has been surprisingly found that an increased average pore diameter does not, in the context of the hydrogenation process of this invention, contribute to an extended process life-time. Thus, larger sized pores in the catalyst and the better access they provide to the interior surface area of the catalyst do not contribute to the increased life-time benefits of this invention.

It has also been surprisingly discovered that even with a reduced average pore diameter, the benefits of the deliberately increased total surface area concept of this invention are still realized, and this is so even with a reduced amount of metal catalyst on the support material.

The catalyst of this invention can be made in any conventional manner well known in the art. One such preparation method is the well known "incipient wetness" process wherein, for example, a salt of the catalyst metal dissolved in an aqueous solution is applied on an alumina support form such as an extrudate. The catalyst salt impregnated extrudate is dried, leaving catalyst on the extrudate. The dried catalyst is then calcined to get the catalyst left on the extrudate into the desired state for use in the pygas hydrotreating/stabilizing operation. The support impregnation process can be repeated as desired to add additional catalyst to the support. The same process steps are used to add one or more promoters of this invention to the same support. For more information for the preparation of catalysts, see *Catalyst Manufacture, Chemical Industries*, Volume 14, published by Marcel Dekker (1983).

The feed material for this invention is any pygas stream, whether full range or a fraction thereof, formed from any hydrocarbon steam cracking process. Such pygas feeds can have a wide variety of poisons and in varying amounts. Generally, they will have from about 30 ppb to about 5 ppm cumulative of a variety of catalyst poisons such as mercury, arsenic, lead, alkalai metal, phosphorus, silicon, iron oxide containing rouge dust (stainless steel corrosion products such as chromium oxide, nickel oxide and the like), sulfur, coke, halides (metal, particularly alkali and alkaline earth metal, chlorides, bromides and fluorides), siloxanes, sulfur containing compounds, nitrogen containing compounds, silica, carbonyls, and mixtures of two or more thereof. Mercury, arsenic, alkali metals, phosphorus, lead, iron oxide, sulfur, hydrogen sulfide, ammonia, and siloxanes are often present together in the same pygas fuel.

Also adding to the challenge of increasing the catalyst life is that some of the poisons tend to be temporary while others tend to have a permanent poisoning effect. Temporary poisons include sulfur, carbonyls, and basic nitrogen. More permanent poisons include caustic, arsenic, mercury, lead, chlorides, phosphorous, transition metals from corrosion dust (Fe, Ni, Mn, Cr). Trace amounts of silicon as siloxanes from their use upstream as emulsion breakers can permanently poison palladium and nickel hydrogenation catalysts. Siloxanes (—O—Si($R_2$)—O—Si($R_2$)—O—), can be straight-chain or cyclic, e.g., hexamethylcyclotrisiloxane and octamethylcyclotetrasiloxane.

Also the tolerance of various catalyst metals to different poisons varies considerably. For example, in comparing a palladium based catalyst and a sulfided nickel based catalyst, the tolerances are (1) for siloxane, 500 ppm on 0.3 weight (wt.) % palladium versus several wt. % silicon on 12–18 wt. % NiS; (2) for arsenic and mercury, 6,000 ppm on 0.3 wt. % palladium to end of life versus 10 to 100 times more tolerance for nickel; (3) for $H_2S$, temporary poison for palladium but permanent for NiS; for basic nitrogen (ammonia), 1 to 100 ppm is a temporary poison to both palladium and NiS; and (4) phosphorus and sodium tend to be permanent poisons for both catalysts.

Siloxanes are a particularly troublesome poison because they tend to decompose when subjected to elevated temperatures to produce, among other things, a silicon dioxide coating on some of the active Group VIII catalyst metal. The catalyst metal that is coated with silicon oxide is rendered inactive for hydrogenation process purposes. Compounding the problem is the fact that siloxane decomposition increases with temperature. For example, siloxane tends to be about 20% decomposed at about 200° F., but about 80% decomposed at about 600° F., the rate of decomposition increasing essentially linearly with increasing temperature.

As shown later, this invention is particularly effective in the handling of silicon poisons which are initially in the siloxane form. In this regard it is to be noted that when siloxanes are present in a pygas more silicon poison is found in the catalyst at the bottom of the hydrogenation tower than in the top of that tower because the bottom exit is at a higher temperature due to the exothermic nature of the hydrogenation process. So silicon poison in the form of siloxanes is indicated by detection of larger amounts of silicon on the catalyst at the bottom of the hydrotreater catalyst bed than at the top.

Accordingly, this invention is particularly effective, as shown hereinafter, with siloxane and arsenic poisons, and more particularly when palladium is the catalyst because silicon preferentially bonds with palladium and palladium is typically deposited on the skin of the alumina support and at low concentrations from about 0.1 to about 0.5 weight percent. This invention is also effective with trace silicon oxide dust which tends to plug catalyst pores.

The catalysts of this invention will contain at least one Group VIII metal dispersed and/or in at least one porous support material. Dispersion of the Group VIII metal usually is increased when the surface area of the support is increased. Higher metal dispersion tends to improve selective hydrogenation performance. The Group VIII metal will be present in widely varying amounts depending on the metal(s) present, the composition of the feed, the nature of the poisons in the feed and the like, but will generally be in the range of from about 0.20 to about 30 weight (wt.) % based on the total weight of the catalyst (Group VIII metal plus support material). All wt. % figures herein are based on the total weight of the catalyst unless expressly stated otherwise.

The support material can be any porous material effective for supporting the catalyst metal in a pygas hydrotreating process. The effective element of the inventive concept of this invention is increased total surface area of the catalyst, and not the chemical nature of the support. Accordingly, a wide variety of known supports can be used in this invention. Representative, but not all inclusive samples include alumina, silica alumina, carbon (activated, amorphous or graphitic), silica, alumino silicates, clay, aluminate spinal (iron or nickel), and zeolites.

If a suite of individual catalysts is available, each catalyst having a finite total surface area, and the plurality of catalysts in said suite have a range of differing total surface areas which, within said range, increase from individual catalyst to individual catalyst from a minimum surface area value to a maximum surface area value, pursuant to this invention, one skilled in the art would deliberately choose and employ one of the larger total surface area catalysts in that suite. Preferably, the employed catalyst would be in the upper half of said range, more preferably in the top quarter.

In any event, the catalyst chosen and employed would have a total surface area of at least about 30 square meters per gram of catalyst, more preferably at least about 100 square meters per gram of catalyst. In said total surface area range, the catalyst chosen and employed is substantially larger than said range minimum, preferably larger than said minimum by about 100%, more preferably larger by about 200%. The ratio of the surface area of the support material to the surface area of the Group VIII metal of the employed catalyst can be at least about 5/1 depending on the catalyst metal(s) chosen, and can be at least about 40/1. More particularly, such ratio can be at least about 5/1 for iron, cobalt and/or nickel containing catalysts and at least about 40/1 for palladium and/or platinum containing catalysts.

Surface areas can be measured by the well known BET (Brunaer, Emmett and Teller) nitrogen absorption method. Average pore diameters are measured by the well known nitrogen adsorption/desorption process. For more information on these processes see *Adsorption, Surface Area and Porosity. Second Edition*, S. J. Gregg and K. Sing, published by Academic Press (1982).

Accordingly, by this invention more catalyst poisons are removed from the pygas being hydrogenated with less deactivation of active catalyst metal sites thereby increasing the life-time activity of the catalyst and, thereby the operational life-time of the process.

The operating conditions for the process of this invention will vary widely, but will generally be at least about 100° F.

up to about 700° F., at from about 100 to about 500 psig, and a weight hourly space velocity (WHSV) feed rate of from about 1 to about 15 $h^{-1}$. At a temperature above 100° F., silicon from siloxane will start to be removed with at least 10% silicon (from siloxane) removal being achieved and greater removal at higher operating temperatures. Generally at least about 10 wt. % based on the total weight of the poisons in the pygas are removed by this invention.

EXAMPLE

Three commercially available hydrogenation catalysts were employed in a conventional pygas first stage stabilization process. The catalysts are shown in Table 1.

TABLE 1

| Fresh Catalyst | Palladium Content, wt. % | Catalyst Support | Silicon Content, wt. % | Arsenic Content, wt. % |
|---|---|---|---|---|
| 1 | 0.33 | Alumina | <0.04 | 0 |
| 2 | 0.30 | Alumina | — | — |
| 3 | 0.31 | Alumina | <0.03 | 0 |

The total surface area (square meters per gram of catalyst by BET nitrogen absorption) and average pore diameter (angstroms by nitrogen adsorption/desorption) for the fresh catalysts is shown in Table 2.

TABLE 2

| Fresh Catalyst | Total Surface Area, $M^2$/gm | Average Pore Diameter, Angstroms |
|---|---|---|
| 1 | 34 | 298 |
| 2 | 100 | — |
| 3 | 126 | 167 |

Each of catalysts 1 through 3 were used in a separate first stage process using a full boiling range pygas feed composed of about 40 wt. % $C_3$–$C_{10}$ hydrocarbons (saturates, olefins, and diolefins); about 54 wt. % of a mixture of benzene, ethylbenzene, toluene and xylenes; and about 4 wt. % styrene, with the remainder being essentially $C_{11}$ and heavier hydrocarbons and containing about 4 ppm of a mixture of arsenic, siloxanes, mercury, sodium, phosphorus, sulfur, hydrogen sulfide, and ammonia, all wt. % being based on the total weight of the pygas.

Separate portions of pygas were hydrogenated using each of catalysts 1 through 3 using operating conditions of about 150 to about 300° F. throughout the hydrotreater, about 380 psig, and a WHSV of about 8 to about 12 $h^{-1}$. Each fresh (unused) hydrogenation process catalyst was run to the end of its operational life-time, and the catalyst then analyzed for its silicon and arsenic content. The results are shown in Table 3.

TABLE 3

| Used Catalyst | Catalyst Life, In Years | Silicon Content, wt. % | Arsenic Content, wt. % |
|---|---|---|---|
| 1 | 0.6 | 0.25 | 0.03 |
| 2 | 2.5 | 0.94 | 0.20 |
| 3 | 3.5 | 1.90 | 0.20 |

These results show that catalyst 3 with its substantially larger total surface area of 126 had a very substantially lengthened operating life time. These results also show that catalyst 3 achieved its increased life-time over catalysts 1 and 2 even though it had a substantially smaller average pore diameter of 167 and a smaller palladium content of 0.31.

The results also show that substantial amounts of silicon and arsenic were trapped by each catalyst in the course of its useful life.

Used catalyst 1 from the top and bottom of its hydrotreater was separately analyzed for its bulk silicon content by the Inductively Coupled Plasma and X-ray Flourescence methods. The results are shown in Table 4.

TABLE 4

| Used Catalyst | Silicon Content at Top, wt. % | Silicon Content at Bottom, wt. % |
|---|---|---|
| 1 | 0.22 | 0.28 |

The hydrotreater for catalyst 1 had an exit temperature at the bottom of the hydrotreater of at least about 80 to about 150° F. higher than the temperature at the top of the hydrotreater. Table 4 shows more silicon deposited on the catalyst at the bottom than on the catalyst at the top. This indicates that a significant amount of the silicon deposited on the catalyst as a whole came from thermally decomposed siloxanes since higher temperatures at the bottom of the catalyst bed causes more silicon to decompose.

Thus, it can be seen from the above data that a larger total surface area for a Group VIII catalyst used in pygas stabilization yields a substantially extended catalyst life-time, particularly as to silicon poisoning from siloxanes and to arsenic poisoning.

It can also be seen from this data that the longer operational life-time benefit for the catalyst and process of this invention is not dependant on large pores, (e.g., 298 Angstroms or larger) and can be achieved with the same or even lesser loading of active catalyst metal.

What is claimed is:

1. A method for increasing the life-time of a pyrolysis gasoline hydrogenation process comprising providing a pyrolysis gasoline feed, having a plurality of hydrogenation catalysts available, each such catalyst consisting essentially of at least one Group VIII metal carried on at least one porous support material, each said catalyst having a finite total surface area, finite average pore diameter, and finite Group VIII metal content, said plurality of catalysts having a range of total surface areas, average pore size diameters, and Group VIII metal contents, said surface area range increasing from individual catalyst to individual catalyst from a minimum to a maximum, employing in said process without regard to relative average pore size diameters and Group VIII metal contents of said available plurality of catalysts an individual catalyst from said available plurality of catalysts that has one of the larger total surface areas within said range, and hydrogenating said feed in the presence of said employed catalyst, whereby said life-time of said hydrogenation process is increased over what it would have been had a smaller total surface area catalyst been employed.

2. The method of claim 1 wherein the total surface area of said employed catalyst is in the upper half of said range.

3. The method of claim 1 wherein the total surface area of said employed catalyst is in the top quarter of said range.

4. The method of claim 1 wherein said employed total surface area is larger than the minimum of said range by at least about 100%.

5. The method of claim 4 wherein said employed total surface area is larger by at least about 200%.

6. The method of claim 1 wherein said employed total surface area is at least about 30 square meters per gram of catalyst.

7. The method of claim 6 wherein said employed total surface area is at least about 100 square meters per gram of catalyst.

8. The method of claim 1 wherein said employed total surface area is composed of the surface area of said at least one Group VIII metal and the surface area of said at least one support material, and the weight ratio of said support material to said at least one Group VIII metal is at least about 5/1.

9. The method of claim 8 wherein said weight ratio is at least about 40/1.

10. The method of claim 8 wherein said Group VIII metal is selected from the group consisting essentially of iron, cobalt, nickel, and mixtures thereof.

11. The method of claim 9 wherein said Group VIII metal is selected from the group consisting essentially of palladium, platinum, and mixtures thereof.

12. The method of claim 9 wherein said Group VIII metal is palladium and said support is alumina.

13. The method of claim 1 wherein said support is selected from the group consisting essentially of alumina, silica-alumina, carbon, silica aluminosilicate, clay, spinel, zeolite, and mixtures of two or more thereof.

14. The method of claim 12 wherein said employed total surface area is at least about 100 square meters per gram.

15. The method of claim 14 wherein said catalyst contains at least about 0.10 weight per cent palladium based on the total weight of said employed catalyst.

16. The method of claim 1 wherein said gasoline contains at least one catalyst poison and at least part of said at least one poison is removed from said feed by said employed catalyst.

17. The method of claim 16 wherein said poison is at least one of arsenic, silica dust, and silicon from at least one siloxane.

18. The method of claim 17 wherein the process operating temperature is at least about 100° F.

* * * * *